United States Patent [19]

Bogese, II

[11] 4,262,983

[45] Apr. 21, 1981

[54] CIRCUIT BOARD CONNECTOR FOR INSULATED WIRE

[75] Inventor: Stephen B. Bogese, II, Roanoke, Va.

[73] Assignee: Virginia Plastics Company, Roanoke, Va.

[21] Appl. No.: 10,547

[22] Filed: Feb. 8, 1979

[51] Int. Cl.[3] ..... H01R 4/24

[52] U.S. Cl. ..... 339/97 C; 339/217 S; 339/276 T

[58] Field of Search ..... 339/97 R, 17 C, 97 C, 339/97 P, 96, 223, 217 PS, 217 S, 275 R, 275 C, 98, 99, 275 T, 276 T, 17 R, 18, 252 P

[56] References Cited

U.S. PATENT DOCUMENTS

| | | | |
|---|---|---|---|
| 2,143,564 | 1/1939 | Lybarger | 339/252 P |
| 2,462,867 | 3/1949 | Hubbell | 339/275 T |
| 3,072,880 | 1/1963 | Olsson | 339/217 |
| 3,077,027 | 2/1963 | Sola et al. | 29/155.55 |
| 3,193,795 | 7/1965 | Krehbiel | 339/252 P X |
| 3,504,328 | 3/1970 | Olsson | 339/17 |
| 3,631,373 | 12/1971 | Matrisian | 339/17 C |
| 3,780,211 | 12/1973 | Vernet | 339/17 C |
| 3,786,402 | 1/1974 | Horecky | 339/217 S |
| 3,808,588 | 4/1974 | McGregor | 339/217 S |
| 3,845,456 | 10/1974 | Michaels | 339/97 R |
| 3,880,488 | 4/1975 | Collier | 339/97 C |
| 3,941,449 | 3/1976 | Baumanis | 339/217 S |
| 3,963,316 | 6/1976 | Williams | 339/17 C |

*Primary Examiner*—John McQuade
*Assistant Examiner*—John S. Brown
*Attorney, Agent, or Firm*—Saidman & Sterne

[57] ABSTRACT

A connector and terminal for insulated wire which includes a pin section particularly adapted to extend through an aperture in a circuit board. The connector, which is formed of a single piece of electrically conductive metal includes a tubular section adapted to receive and make electrical contact with an insulated wire, and an isolation section which is positioned between the tubular section and the pin section. The isolation section permits the pin section to be wave soldered on the other side of the circuit board without being contaminated by the insulated wire, and also protects the insulated wire from damage during soldering. The isolation section may take one of several forms, and may include a heat sink for further dissipating the heat resulting from the soldering process. Insulation displacement tynes are provided in the tubular section for making positive electrical contact with the wire. The pin section itself may be either press fit through the circuit board aperture, or may include one of several different locking features.

11 Claims, 9 Drawing Figures

CIRCUIT BOARD CONNECTOR FOR INSULATED WIRE

BACKGROUND OF THE INVENTION

1. Field of the Invention

The present invention is related to electrical connectors and terminals and, more particularly, is directed towards a terminal for insulated wire which is particularly designed to be connected through a circuit board.

2. Description of the Prior Art

It is frequently necessary to be able to quickly and easily terminate an insulated wire to a circuit board. To facilitate mass production, electrical terminals or connectors have been developed which are designed to protrude through an aperture in the circuit board, one side of the terminal being designed to be connected to the insulated wire while the other end of the terminal on the other side of the board may be connected to other circuit components. One effective known technique for quickly effecting a connection of the second end of the connector is by wave soldering.

I am aware of several prior art patents which teach various electrical connectors and terminals. These include: U.S. Pat. Nos. 3,072,880; 3,077,027; 3,504,328; 3,631,373; 3,780,211; 3,786,402; 3,808,588; and 3,880,488.

Exemplary of the foregoing is U.S. Pat. No. 3,786,402 which teaches an electrical terminal comprising a U-shaped sheet metal body and which is particularly adapted to protrude through an aperture in a printed circuit board. The insulated wire must initially be stripped and then wrapped about the upper portion of the terminal. While this procedure may be used with some types of insulated wire, it is extremely difficult to accomplish with several types of insulated wires which cannot be effectively stripped and/or soldered. Such types of wire include tinsel wire which is a combination of fibers and metal ribbons, and fine gauge stranded wire which is frequently provided with a tough, abrasion-resistant insulation.

U.S. Pat. No. 3,780,211 also teaches a connection member for a printed circuit board wherein the wire conductor is soldered into a cylindrical cup on one side of the board. Again, the conductor wire must be stripped prior to insertion into the cup, which is difficult for the type of stranded wire mentioned above. Additionally, tinsel wire cannot be soldered effectively. While fine stranded wire can be soldered, attempts to remove the insulation thereof is likely to result in damage to the strands, making this structure suspect for assembly on a mass production basis.

U.S. Pat. No. 3,808,588 illustrates another approach wherein a multi-strand wire is stripped and fastened to the connector. The strands extend into the circuit board area on both sides of the board, which means that wave soldering of the protruding end of the terminal will solder both the terminal and the strands together. This creates obvious obstacles with respect to hard-to-solder tinsel wire, while fine stranded wire will encounter the same difficulties mentioned above with respect to Pat. No. 3,780,211.

The prior art terminal and connector designs also suffer from two additional major deficiencies. One disadvantage results from those terminals which place the insulation of the wire close to the circuit board. During wave soldering, the heat of the process can cause the insulation to melt and flow. If the insulation flows into the hole where the connector pin is inserted, the insulation can cause a bad solder connection around the pin.

A second major difficulty, which also results from melting of the insulation, is that the solder bath can become contaminated, which would result in costly down-time for the production line.

It is towards overcoming the above-mentioned deficiencies that the present invention is advanced.

OBJECTS AND SUMMARY OF THE INVENTION

It is therefore a primary object of the present invention to provide a terminal for insulated wire for connecting same to a printed circuit board which overcomes all of the deficiencies noted above with respect to prior art connectors and terminals.

Another object of the present invention is to provide a circuit board connector for insulated wire which can be wave soldered without damaging the terminated insulated conductor.

An additional object of the present invention is to provide a circuit board connector which may be utilized with a great variety of insulated conductors, and which does not require the end of the wire to be stripped prior to termination.

An additional object of the present invention is to provide a circuit board connector for insulated wire which effectively prevents the insulation from being heated during wave soldering of the pin portion of the connector.

A still further object of the present invention is to provide a circuit board connector which may be utilized to terminate a wide variety of insulated conductors, such as tinsel wire and fine stranded wire, and does not require such wire to be soldered to the connector, and at the same time permits wave soldering of the pin end of the connector on the other side of the circuit board without damage to the insulated wire, connector, or contamination of the solder bath.

An additional object of the present invention is to provide a terminal which may be easily and readily connected to a variety of insulated wires, and may be quickly and simply installed in a circuit board.

The foregoing and other objects are attained in accordance with one aspect of the present invention through the provision of an electrical connector which comprises an electrically conductive piece of sheet metal which is integrally formed to provide tubular means for receiving an insulated wire therewithin, pin means adapted to extend through an aperture in a circuit board, and isolation means extending between the tubular means and the pin means for spacing the tubular means from the top surface of the board.

In accordance with more specific aspects of the present invention, the tubular means may include means integrally formed therefrom for piercing the insulation of the insulated wire and thereby establishing electrical contact with the wire. The insulation piercing means more particularly may comprise at least one substantially triangularly shaped tyne stamped from the tubular means so as to extend inwardly thereof. A second tyne may be positioned below and spaced laterally on the tubular means from the first tyne. The wire may comprise a multi-strand wire covered by a cylindrically shaped insulator, both the wire and insulator terminating in the same plane at the bottom end of the tubular means, so that the insulated wire need not be prestripped prior to connection within the tubular means. The tubular means may comprise a substantially cylindrical barrel.

In accordance with another aspect of the present invention, the isolation means may include means for dissipating the heat from the piece of sheet metal. In a preferred embodiment, the isolation means comprises a substantially planar section of metal while the heat dissipating means comprises aperture means formed in the planar section for permitting air to circulate therethrough.

In accordance with another aspect of the present invention, the isolation means may comprise means for substantially covering the bottom end of the cylindrical barrel. The covering means may more particularly comprise a piece of metal extending integrally from one side of the barrel underneath the bottom end thereof to the other side of the barrel. A shoulder extends integrally from the piece of metal at the other side of the barrel to the pin means for seating the connector on the top surface of the circuit board.

In accordance with another aspect of the present invention, the covering means may comprise a substantially conically shaped metallic portion extending integrally from the bottom end of the barrel to the pin means, and the pin means may comprise a tubular portion extending integrally from the isolation means and adapted to be press fit within the aperture in the circuit board.

In accordance with yet another aspect of the present invention, the pin means may comprise a substantially planar section of metal extending integrally from the isolation means and adapted to be press fit within the aperture in the circuit board. The planar section of metal may have formed therein a spring lock finger means projecting upwardly and outwardly therefrom for locking the pin means in the aperture in the circuit board.

In accordance with yet another aspect of the present invention, the pin means may comprise a first leg extending integrally and vertically downwardly from the isolation means, and a second vertical leg extending integrally and upwardly adjacent to and from the first vertical leg. The first and second legs form resilient spring means having a width greater than that of the aperture in the board, and the second leg preferably terminates in an offset tip extending towards the first leg for snap-fit locking the pin means within the aperture.

The barrel-shaped tubular means is preferably formed by crimping a substantially U-shaped channel member after the insulated wire has been positioned therewithin. The crimping process simulataneously causes the tynes to displace the insulation and make electrical contact with the wire.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 1:
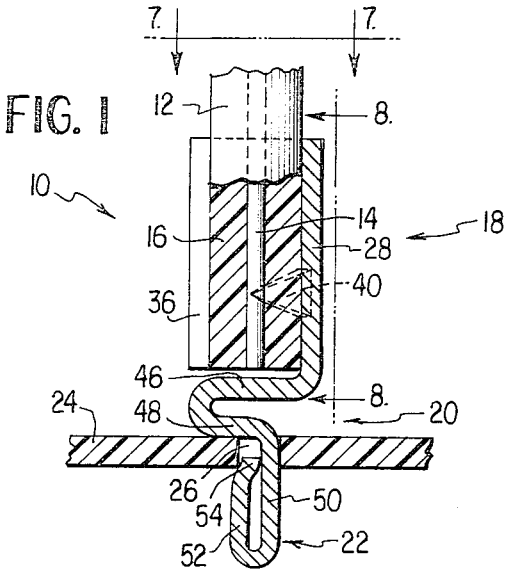
FIG. 1 is a side sectional view of a first preferred embodiment of the electrical connector of the present invention.

Referring now to the drawings, wherein like reference numerals represent identical or corresponding parts throughout the several views, and more particularly in FIG. 1, there is illustrated a side sectional view of a connector of the present invention which is indicated generally by reference numeral 10. Connector 10 serves as a terminal for an insulated wire 12. Insulated wire 12 may be of substantially any variety, including tinsel wire or fine gauge stranded wire. Insulated wire 12 comprises a conducting wire or multi-strand wire 14 encapsulated by a substantially cylindrical insulation 16.

Connector 10 of the present invention comprises three main sections: an insulation displacement section indicated generally by reference numeral 18; an isolation section indicated generally by reference numeral 20; and a pin section indicated generally by reference numeral 22. Clearly, the pin section 22 of connector 10 is designed to be positioned through an aperture 26 formed in a printed circuit board 24 to enable same to be wave soldered.

Figure 6:
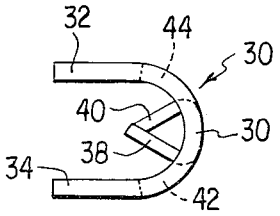
FIG. 6 is a top view of one embodiment of the insulation displacement section of the present invention prior to crimping.
Figure 7:
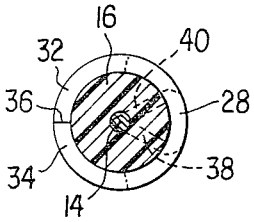
FIG. 7 is a view of the embodiment of FIG. 6 after the wire has been inserted and the crimping has taken place, taken along line 7—7 of FIG. 1.

Referring now to FIGS. 1, 6 and 7, the insulation displacement section 18 of connector 10 includes a barrel portion 28 which is preferably formed from an initially U-shaped channel member 30, as illustrated in FIG. 6. Channel member 30 includes a pair of substantially parallel side walls 32 and 34 connected by a curved rear wall 33.

Figure 8:
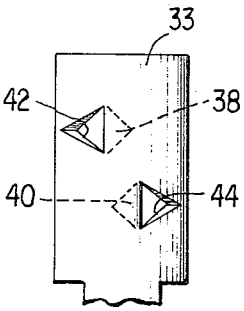
FIG. 8 is a side view of the preferred embodiment illustrated in FIG. 1 and taken along line 8—8 thereof.

As seen in FIGS. 6 and 8, displaced from the curved rear wall 33 are a pair of insulation piercing prongs or tynes 38 and 40. Tynes 38 and 40 are preferably pressed from wall 33 to leave triangular apertures 42 and 44 in barrel 28. The tynes 38 and 40 extend from opposite sides of rear wall 33 towards the center of channel member 30, as indicated clearly in FIG. 6, so as to intercept the insulated wire 12 from different directions to ensure good electrical contact with multi-strand conductor 14.

In operation, the insulated wire 12 is positioned within channel member 30, whereafter sides 32 and 34 are crimped until their edges 36 meet as illustrated in FIG. 7. The crimping of sides 32 and 34 results in the formation of barrel portion 28 and simultaneously causes tynes 38 and 40 to pierce the insulation 16 and make good electrical contact with the center conductor or conductors 14.

The insulation-piercing tynes 38 and 40 clearly obviate the necessity of stripping the end of insulated wire 12, and also obviate the need for any solder connection within section 18.

The isolation section 20 of connector 10 includes a bottom wall 46 which extends integrally from rear wall 33 towards the other side of barrel 28 so as to substantially enclose the bottom of barrel 28 and insulated wire 12. Extending from bottom wall 46 and doubling back towards the pin section 22 is a shoulder 48 which provides a seat for connector 10 against the top surface of circuit board 24.

The function of isolation section 20 is to space the insulation displacement section 18 from the circuit board 24, and to provide protection against possible melting of insulation 6 as a result of subsequent wave soldering of pin section 22. Bottom wall 46 also serves the purpose of preventing any insulation that may happen to melt from entering aperture 26 in circuit board 24, which in turn prevents a bad solder connection of pin section 22 and also helps prevent possible contamination of the solder bath.

Pin section 22 of connector 10 includes a first leg 50 which extends vertically downwardly from shoulder 48, and a second vertical leg 52 which extends integrally from the lower portion of the first leg 50 and terminates in an offset tip 54. The legs 50 and 52 act as a spring terminal and may be compressed as the pin section 22 is placed through aperture 26. When properly positioned, leg 52 and tip 54 will snap into the position illustrated to virtually lock the connector 10 in place.

Figure 2:
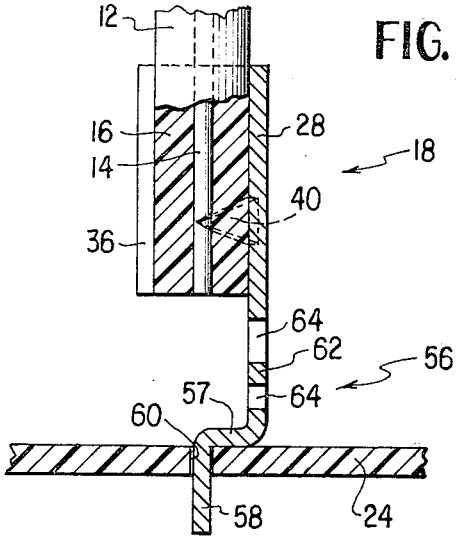
FIG. 2 is a view similar to FIG. 1 but illustrating an alternate embodiment of the present invention.
Figure 3:
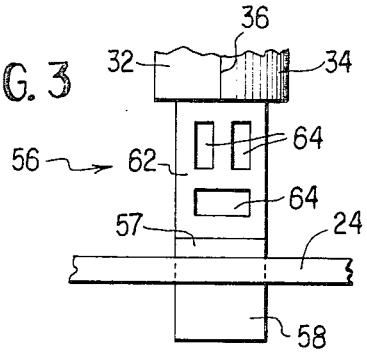
FIG. 3 is a front view of a portion of the alternate embodiment of FIG. 2.

Referring now to FIGS. 2 and 3, an alternate construction of the connector of the present invention is illustrated. The insulation displacement section 18 is the same as in the first embodiment. Reference numeral 56 indicates generally a heat sink isolation section which comprises a substantially flat piece of metal 62 extending downwardly from the rear wall 33 to an offset seat 57. A plurality of apertures 64 are preferably formed in flat stock 62 to permit circulation of air therethrough so that any heat generated by the wave soldering process may be dissipated to prevent melting of insulation 16.

The pin section 58 of the embodiment of FIG. 2 is aligned with wires 14 and comprises a planar piece of metal which can be press fit into aperture 60 of circuit board 24.

Figure 4:
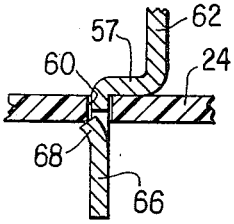
FIG. 4 is a side sectional view of an alternate embodiment of a pin section of the present invention.

FIG. 4 illustrates an alternate embodiment of a pin section 66 wherein a spring-lock finger 68 may be pressed from the flat piece of metal 66. Finger 68 projects upwardly and outwardly in such a manner so that it may be compressed in the plane of section 66 as same is being inserted through aperture 60. When offset 57 is fully seated against the top surface of circuit board 24, finger 68 will snap into the position illustrated to firmly lock the connector in place prior to wave soldering of the pin section 66.

Figure 5:
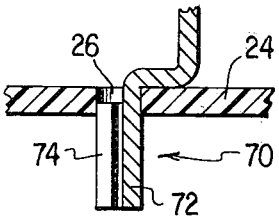
FIG. 5 is a view similar to FIG. 4 but illustrating yet another alternate embodiment of a pin section of the present invention.

FIG. 5 illustrates yet another alternate embodiment of a pin section 70 which comprises a tubular barrel 72 having adjacent edges 74. Barrel 72 may be formed from the flat stock, such as from pin section 58 of FIGS. 3 and 4, in the event a larger pin section 70 is required to be press fit through aperture 26 of circuit board 24.

Figure 9:
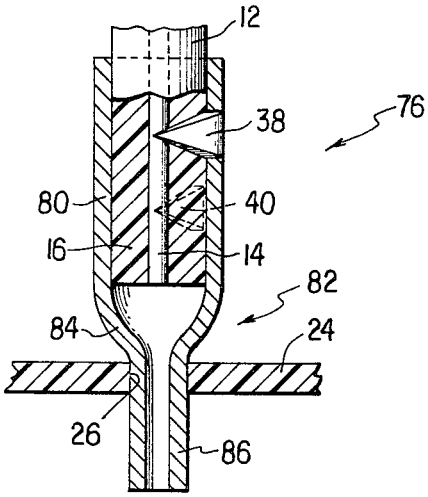
FIG. 9 is a view similar to FIGS. 1 and 2 but illustrating yet another alternate embodiment of the electrical connector of the present invention.

Referring now to FIG. 9, there is illustrated a side section of yet another alternate embodiment of a connector in accordance with the present invention. The insulation displacement section 76, having a pair of insulation piercing tynes 38 and 40, is formed as a substantially cylindrical tube 80. The isolation section is indicated generally by reference numeral 82. Isolation section 82 is preferably formed as a tapered cone 84 so as to extend integrally from tube 80 to a tubular pin section 86 which is press fit within aperture 26 of circuit board 24. The walls of the conical isolation section 84 taper so that only metal conductor 14 is exposed and the insulation 16 is fully contained.

Obviously, numerous modifications and variations of the present invention are possible in light of the above teachings. It is therefore to be understood that within the scope of the appended claims, the invention may be practiced otherwise than as specifically described herein.

I claim as my invention:

1. An electrical connector, which comprises an electrically conductive piece of sheet metal which is integrally formed to provide:

tubular means adapted to receive an insulated wire therewithin;

pin means adapted to extend through an aperture in a circuit board; and isolation means extending between said tubular means and said pin means for spacing said tubular means from the top surface of said board;

wherein said tubular means includes means integrally formed therefrom adapted to pierce the insulation of said insulated wire and to establish electrical contact with said wire; and wherein said tubular means comprises a cylindrical barrel, said insulated wire adapted to extend to the bottom end of said barrel, and said isolation means further comprises means for substantially covering said bottom end of said barrel.

2. An electrical connector as set forth in claim 1, wherein said insulation piercing means comprises at least one substantially triangularly shaped tyne stamped from said tubular means so as to extend inwardly thereof.

3. An electrical connector as set forth in claim 2, further comprising a second tyne positioned below and spaced laterally on said tubular means from said at least one tyne.

4. An electrical connector as set forth in claim 1, wherein said isolation means includes means for dissipating the heat from said piece of sheet metal.

5. An electrical connector as set forth in claim 1, wherein said covering means comprises a piece of metal extending integrally from one side of said barrel underneath said bottom end thereof to the other side of said barrel.

6. An electrical connector as set forth in claim 5, wherein said isolation means further comprises a shoulder extending integrally from said piece of metal at said other side of said barrel to said pin means for seating said connector on the top surface of said board.

7. An electrical connector as set forth in claims 1 or 6, wherein said pin means comprises a first leg extending integrally and vertically downwardly from said isolation means and a second vertical leg extending integrally and upwardly adjacent to and from said first vertical leg, said first and second legs forming resilient spring means having a width greater than that of said aperture in said board.

8. An electrical connector as set forth in claim 7, wherein said second leg terminates in offset tip means extending towards said first leg for locking said pin means in said aperture.

9. An electrical connector as set forth in claim 1, wherein said covering means comprises a substantially conically shaped metallic portion extending integrally from said bottom end of said barrel to said pin means.

10. An electrical connector as set forth in claims 1 or 9, wherein said pin means comprises a tubular portion extending integrally from said isolation means and adapted to be press fit within said aperture in said circuit board.

11. An electrical connector as set forth in claim 1, wherein said tubular means is formed from crimping a substantially U-shaped channel member.

* * * * *